US006811678B2

(12) United States Patent
Strezov et al.

(10) Patent No.: US 6,811,678 B2
(45) Date of Patent: Nov. 2, 2004

(54) ELECTROCHEMICAL REDUCTION OF BERYLLIUM OXIDE IN AN ELECTROLYTIC CELL

(75) Inventors: Lazar Strezov, Adamstown (AU); Ivan Ratchev, Georgetown (AU); Steve Osborn, Valentine (AU)

(73) Assignee: BHP Billiton Innovation Pty Ltd., Melbourne (AU)

( * ) Notice: Subject to any disclaimer, the term of this patent is extended or adjusted under 35 U.S.C. 154(b) by 254 days.

(21) Appl. No.: 10/261,582

(22) Filed: Oct. 2, 2002

(65) Prior Publication Data

US 2004/0040861 A1 Mar. 4, 2004

(30) Foreign Application Priority Data

Aug. 28, 2002 (AU) ..... 2002951048

(51) Int. Cl.[7] ..... C25C 3/34; C25C 7/00
(52) U.S. Cl. ..... 205/403; 204/243.1
(58) Field of Search ..... 205/403; 204/243.1

(56) References Cited

U.S. PATENT DOCUMENTS 1,511,829 A * 10/1924 Dickinson ..... 420/401
4,581,065 A * 4/1986 Orgera ..... 75/593
6,663,763 B2 * 12/2003 Strezov et al. ..... 205/367

FOREIGN PATENT DOCUMENTS

WO WO 99/64638 A * 12/1999 ..... C23C/8/40

* cited by examiner

*Primary Examiner*—Roy King
*Assistant Examiner*—Harry D. Wilkins, III
(74) *Attorney, Agent, or Firm*—Miles & Stockbridge P.C.; Edward J. Kondracki

(57) ABSTRACT

An electrolytic cell for reducing a beryllium oxide in solid state, and a method for achieving this reduction, are provided. The electrolytic cell and method employ an anode, a cathode formed in part from beryllium oxide, and a molten electrolyte which includes cations of a metal that is capable of reducing beryllium oxide. The reduction process involves operating the cell at a potential that is above a potential at which the reducing cations in the electrolyte will deposit as a metal on the cathode.

11 Claims, 1 Drawing Sheet

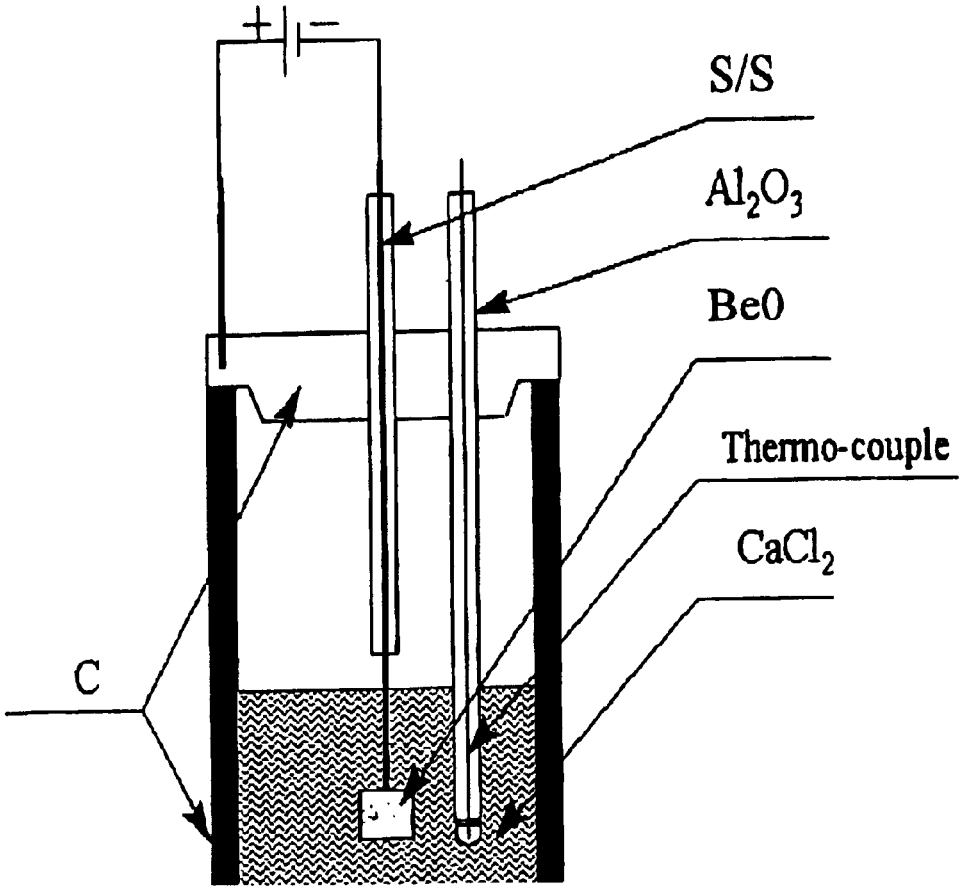
+
−
S/S
$Al_2O_3$
BeO
Thermo-couple
$CaCl_2$
C

ELECTROCHEMICAL REDUCTION OF BERYLLIUM OXIDE IN AN ELECTROLYTIC CELL

BACKGROUND OF THE INVENTION

1. Field of the Invention

The present invention relates to electrochemical reduction of beryllium oxide in a solid state in an electrolytic cell.

The present invention relates particularly to electrochemical reduction of beryllium oxide in a solid state to produce high purity beryllium metal in an electrolytic cell.

2. Description of Related Art

Beryllium metal has a combination of physical and mechanical properties, such as low weight, stiffness, resistance to corrosion from acids, transparency to X-rays and other electromagnetic radiation, and electrical and thermal conductivity, that make it useful for various applications in metal, alloy and oxide forms.

Beryllium metal is used principally in aerospace and defence applications. Its high stiffness, light weight, and dimensional stability within a wide temperature range make it useful in satellite and space vehicle structures, inertial guidance systems for missiles, military aircraft brakes, structural components of military aircraft, and space optical system components.

Beryllium alloys include beryllium-copper, beryllium-nickel, and beryllium-aluminium alloys, of which beryllium-copper alloys are the most important commercially. Beryllium-copper alloys are used in a wide range of applications that require electrical and thermal conductivity, high strength and hardness, good corrosion and fatigue resistance, and non-magnetic properties. Beryllium-copper strip is manufactured into springs, connectors, and switches for use in applications in automobiles, aerospace, radar, and telecommunications, factory automation, computers, and instrumentation and control systems.

Beryllium metal is extracted from beryllium oxide-containing minerals beryl ($3BeO—Al_2O_3—6SiO_2$) and bertrandite ($4BeO—2SiO_2—H_2O$) by chemical reduction. However, energy requirements and therefore production costs for producing beryllium by conventional chemical reduction technology currently being used are high.

An object of the present invention is to provide an alternative method of extracting beryllium metal from beryllium oxides.

SUMMARY OF THE INVENTION

The present invention was made during the course of an on-going research project on the electrochemical reduction of a range of metal oxides in a solid state in an electrolytic cell that is being carried out by the applicant.

During the course of the research project the applicant carried out experimental work on a range of different metal oxides in an electrolytic cell that included a graphite crucible that formed an anode of the cell, a pool of molten $CaCl_2$-based electrolyte in the crucible, and a cathode that included solid metal oxides. One of the metal oxides tested by the applicant is beryllium oxide.

Accordingly, the present invention provides a method of reducing beryllium oxide in a solid state in an electrolytic cell, which electrolytic cell includes an anode, a cathode formed at least in part from beryllium oxide, and a molten electrolyte, the electrolyte including cations of a metal that is capable of chemically reducing beryllium oxide, and which method includes a step of operating the cell at a potential that is above a potential at which cations of the metal that is capable of chemically reducing beryllium oxide deposit as the metal on the cathode, whereby the metal chemically reduces beryllium oxide.

The applicant does not have a clear understanding of the electrolytic cell mechanism at this stage. Nevertheless, whilst not wishing to be bound by the comments in this paragraph, the applicant offers the following comments by way of an outline of a possible cell mechanism. The experimental work carried out by the applicant produced evidence of Ca metal in the electrolyte. The applicant believes that, at least during the early stages of operation of the cell, the Ca metal was the result of electrodeposition of $Ca^{++}$ cations as Ca metal on electrically conductive sections of the cathode. The experimental work was carried out using a $CaCl_2$-based electrolyte at a cell potential below the decomposition potential of $CaCl_2$. The applicant believes that the initial deposition of Ca metal on the cathode was due to the presence of $Ca^{++}$ cations and $O^{--}$ anions derived from CaO in the electrolyte. The decomposition potential of CaO is less than the decomposition potential of $CaCl_2$. In this cell mechanism the cell operation is dependent at least during the early stages of cell operation on decomposition of CaO, with $Ca^{++}$ cations migrating to the cathode and depositing as Ca metal and $O^{--}$ anions migrating to the anode and forming CO and/or $CO_2$ (in a situation in which the anode is a graphite anode). The applicant believes that the Ca metal that deposited on electrically conductive sections of the cathode was deposited predominantly as a separate phase in the early stages of cell operation and thereafter dissolved in the electrolyte and migrated to the vicinity of the beryllium oxide in the cathode and participated in chemical reduction of beryllium oxide. The applicant also believes that at later stages of the cell operation part of the Ca metal that deposited on the cathode was deposited directly on partially deoxidised beryllium oxide and thereafter participated in chemical reduction of beryllium oxide. The applicant also believes that the $O^{--}$ anions, once extracted from the beryllium oxide, migrated to the anode and reacted with anode carbon and produced CO and/or $CO_2$ and released electrons that facilitated electrolytic deposition of Ca metal on the cathode.

The beryllium oxide may be any suitable type.

The beryllium oxide may be any suitable form.

By way of example, the beryllium oxide may be in the form of pellets.

Preferably the metal deposited on the cathode is soluble in the electrolyte and can dissolve in the electrolyte and thereby migrate to the vicinity of the cathode metal oxide.

It is preferred that the electrolyte be a $CaCl_2$-based electrolyte that includes CaO as one of the constituents of the electrolyte.

In such a situation it is preferred that the cell potential be above the potential at which Ca metal can deposit on the cathode, i.e. the decomposition potential of CaO.

The decomposition potential of CaO can vary over a considerable range depending on factors such as the composition of the anode, the electrolyte temperature and electrolyte composition.

In a cell containing CaO saturated $CaCl_2$ at 1373K (1100° C.) and a graphite anode this would require a minimum cell potential of 1.34V.

It is also preferred that the cell potential be below the potential at which $Cl^-$ anions can deposit on the anode and form chlorine gas, i.e. the decomposition potential of $CaCl_2$.

In a cell containing CaO saturated $CaCl_2$ at 1373K (1100° C.) and a graphite anode this would require that the cell potential be less than 3.5V.

The decomposition potential of $CaCl_2$ can vary over a considerable range depending on factors such as the composition of the anode, the electrolyte temperature and electrolyte composition.

For example, a salt containing 80% $CaCl_2$ and 20% KCl at a temperature of 900K (657° C.), decomposes to Ca (metal) and $Cl_2$ (gas) above 3.4V and a salt containing 100% $CaCl_2$ at 1373K (1100° C.) decomposes at 3.0V.

In general terms, in a cell containing CaO—$CaCl_2$ salt (not saturated) at a temperature in the range of 600–1100° C. and a graphite anode it is preferred that the cell potential be between 1.3 and 3.5V.

The $CaCl_2$-based electrolyte may be a commercially available source of $CaCl_2$, such as calcium chloride dihydrate, that partially decomposes on heating and produces CaO or otherwise includes CaO.

Alternatively, or in addition, the $CaCl_2$-based electrolyte may include $CaCl_2$ and CaO that are added separately or pre-mixed to form the electrolyte.

It is preferred that the anode be graphite or an inert anode.

The applicant found in the experimental work that there were relatively significant amounts of carbon transferred from the graphite anode to the electrolyte and to a lesser extent, to the beryllium produced at the cathode under a wide range of cell operating conditions. Carbon in the beryllium is an undesirable contaminant. In addition, carbon transfer was partially responsible for low energy efficiency of the cell. Both problems could present significant barriers to commercialisation of electrolytic reduction technology.

The applicant also found that the dominant mechanism of carbon transfer is electrochemical rather than erosion and that one way of minimising carbon transfer and therefore contamination of beryllium produced at the cathode by electrochemical reduction of beryllium oxide is to position a membrane that is permeable to oxygen anions and is impermeable to carbon in ionic and non-ionic forms between the cathode and the anode and thereby prevent migration of carbon to the cathode.

Accordingly, in order to minimise contamination of beryllium produced at the cathode resulting from carbon transfer, it is preferred that the electrolytic cell includes a membrane that is permeable to oxygen anions and is impermeable to carbon in ionic and non-ionic forms positioned between the cathode and the anode to thereby prevent migration of carbon to the cathode.

The membrane may be formed from any suitable material.

Preferably the membrane is formed from a solid electrolyte.

One solid electrolyte tested by the applicant is yttria stabilised zirconia.

According to the present invention there is also provided an electrolytic cell as described above and operating in accordance with the above described method.

BRIEF DESCRIPTION OF THE DRAWINGS

FIG. 1 is a schematic view of an electrochemical cell in accordance with a preferred embodiment of the present application.

DETAILED DESCRIPTION OF THE PREFERRED EMBODIMENTS

The present invention is described further with reference to the following example and FIG. 1.

I. Experimental Method and Electrolytic Cell

The electrolytic cell is shown in FIG. 1.

With reference to FIG. 1, the electrochemical cell included a graphite crucible equipped with a graphite lid. The crucible was used as the cell anode. A stainless steel rod was used to secure electrical contact between a d/c power supply and the crucible. The cell cathode consisted of Kanthal or platinum wire connected at one end to the power supply and a beryllium oxide pellet suspended from the other end of the wire. An alumina tube was used as an insulator around the cathode.

The cell electrolyte was a commercially available source of $CaCl_2$, namely calcium chloride dihydrate, that partially decomposed on heating at the operating temperature of the cell and produced CaO. A thermocouple was immersed in the electrolyte in close proximity to the pellet.

The cell was positioned in a furnace and the experiment was conducted at 950° C. A voltage of 3V was applied between the crucible wall and the Kanthal or platinum wire for a period of 24 hours. The voltage of 3V is below the potential at which $Cl^-$ anions can deposit on the anode at that temperature.

The power-supply maintained a constant voltage throughout the experiment. The voltage and resulting cell current were logged using LabVIEW (TM) data acquisition software.

At the end of the experiment the cell was removed from the furnace and quenched in water. The solid $CaCl_2$ was dissolved by water and the pellet was recovered.

II. Experimental Results

The applicant found that the beryllium oxide pellet had been completely reduced.

X-ray diffraction analysis of the pellet established that the reduced form of the beryllium oxide was Be13Ca.

If necessary from the viewpoint of end use applications, the calcium could be removed from the Be13Ca by further treatment, such as preferential dissolution of calcium in a suitable acid, eg acetic acid, or heating to a molten state and vacuum degassing.

Many modifications may be made to the present invention as described above without departing from the spirit and scope of the invention.

By way of example, whilst the above description focuses on $CaCl_2$-based electrolyte, the invention is not so limited and extends to any other suitable electrolytes (and mixtures of electrolytes). Generally, suitable electrolytes will be salts and oxides that are soluble in salts. One example of a potentially suitable electrolyte is $BaCl_2$.

What is claimed is:

1. A method of reducing beryllium oxide in a solid state in an electrolytic cell, which electrolytic cell includes an anode, a cathode formed at least in part from beryllium oxide, and a molten electrolyte, the electrolyte including cations of a metal that is capable of chemically reducing beryllium oxide, and which method includes a step of operating the cell at a potential that is above a potential at which cations of the metal that is capable of chemically reducing beryllium oxide deposit as the metal on the cathode, whereby the metal chemically reduces beryllium oxide.

2. The method defined in claim 1 wherein the metal deposited on the cathode is soluble in the electrolyte and can dissolve in the electrolyte and thereby migrate to the vicinity of the cathode beryllium oxide.

3. The method defined in claim 2 wherein the electrolyte is a $CaCl_2$-based electrolyte that includes CaO as one of the constituents of the electrolyte and the cell potential is above the potential at which Ca metal can deposit on the cathode.

4. The method defined in claim 3 wherein the cell potential is below the decomposition potential for $CaCl_2$ to minimise forming $Cl_2$ gas at the anode.

5. The method defined in claim 4 wherein the cell potential is less than or equal to 3.5V in a cell operating with an electrolyte at 600–1100° C. and the anode being formed from graphite.

6. The method defined in claim 4 wherein the cell potential is at least 1.3V in a cell operating with the electrolyte at 600–1100° C. and the anode being formed from graphite.

7. The method defined in claim 3 wherein the $CaCl_2$-based electrolyte is a commercially available source of $CaCl_2$ that forms CaO on heating or otherwise includes CaO.

8. The method defined in claim 3 wherein the $CaCl_2$-based electrolyte includes $CaCl_2$ and CaO that are added separately or pre-mixed to form the electrolyte.

9. The method defined in claim 1 wherein the anode is graphite.

10. The method defined in claim 1 wherein the anode is graphite and the electrolytic cell includes a membrane that is permeable to oxygen anions and is impermeable to carbon in ionic and non-ionic forms positioned between the cathode and the anode to thereby prevent migration of carbon to the cathode.

11. An electrolytic cell reducing a beryllium oxide in a solid state, which electrolytic cell includes an anode, a cathode formed at least in part from the beryllium oxide in solid state, and a molten electrolyte, which electrolyte includes cations of a metal that is capable of chemically reducing the cathode beryllium oxide, and which electrolytic cell operates at a potential that is above a potential at which cations of the metal that is capable of chemically reducing the cathode beryllium oxide deposit as the metal on the cathode, whereby the metal chemically reduces the cathode beryllium oxide.

* * * * *